United States Patent [19]

Zeiders

[11] 4,147,451

[45] Apr. 3, 1979

[54] APPARATUS FOR VALVE INSTALLATION IN A FLUME

[75] Inventor: Robert H. Zeiders, York, Pa.

[73] Assignee: Allis-Chalmers Corporation, Milwaukee, Wis.

[21] Appl. No.: 854,899

[22] Filed: Nov. 25, 1977

[51] Int. Cl.[2] ..... E02B 7/20

[52] U.S. Cl. ..... 405/90; 405/106; 251/305

[58] Field of Search ..... 61/28, 29, 22, 22 A; 251/305, 307, 172, 171, 173; 254/104; 269/234; 114/203

[56] References Cited

U.S. PATENT DOCUMENTS

| | | | |
|---|---|---|---|
| 2,547,789 | 4/1951 | Skeel | 254/104 X |
| 2,600,183 | 6/1952 | Arnold et al. | 254/104 X |
| 3,823,913 | 7/1974 | Kurkjian, Jr. | 251/305 |

*Primary Examiner*—Jacob Shapiro

*Attorney, Agent, or Firm*—Robert C. Jones

[57] ABSTRACT

A valve installation for a flume wherein a preinstalled liner is cast in place at the time of flume construction. The valve body with sealing gasket is later installed within the liner. Wedge plates and associated force-applying bevelled washers are installed around the periphery of the valve body within the cast groove which receives the liner. The bevelled washer can be actuated to force the valve body against a gasket compressing the gasket to form a seal and for locking the valve body in the liner. Removal for servicing is easily accomplished by the removal of the bevelled washers.

1 Claim, 3 Drawing Figures

APPARATUS FOR VALVE INSTALLATION IN A FLUME

BACKGROUND OF THE INVENTION

The invention relates to the installation of valves in flumes and more particularly to butterfly valve installations to facilitate the installation and removal of the same.

Fluid control within flumes has been accomplished through the use of valves or slide dams installed in the flumes. Since the flumes are typically constructed of concrete, installation of the valves is difficult. The practice of casting the valve in place at the time of the construction of the flume is difficult because of the necessity of maintaining the valve in positive operating position as the concrete is poured to form the flume. Not only is this type of construction difficult to accomplish, but greatest care must be exercised to avoid damaging the valve during the in-place casting. Also, the in-place casting technique prevents the removal of the valve body for servicing purposes.

Approaches have been made to install the valve after the flume has been constructed and this has presented other problems. An approach to the installation of valves after the flume has been cast is shown in U.S. Pat. Nos. 2,584,364, 3,823,912 and 3,823,913. In these patents, it is taught to mount the valve body within a preformed groove in the flume and hold the valve body in place by means of adjustable deadman bolts. However, the structure disclosed presents problems in that the valve body can be deformed and thereby interfere with the sealing that is effected by the valve disc.

SUMMARY OF THE INVENTION

It is the principal object of the present invention to provide an improved method and apparatus for installing valves in a flume.

More specifically, it is an object of the present invention to provide a method and apparatus to facilitate the installation of valves in flumes that permit removal of the valve for maintenance pruposes.

A further object of the present invention is to provide a method and apparatus for the installation of valves in flumes which do not distort the valve.

According to the preferred embodiment of the invention, the valve body is made to create a seal against a channel liner formed in the flume wall. This is accomplished by causing a wedge plate to exert a force on the valve body to effect the compression of a sealing gasket. The wedge plate exerts its force on the valve body at a point which offers the greatest resistances to deflection. The channel liner with studs may be cast into the flume at the time of flume construction and since it is a separate part, it will not affect the valve body which is mounted later.

DESCRIPTION OF THE PREFERRED EMBODIMENTS

Figure 1:
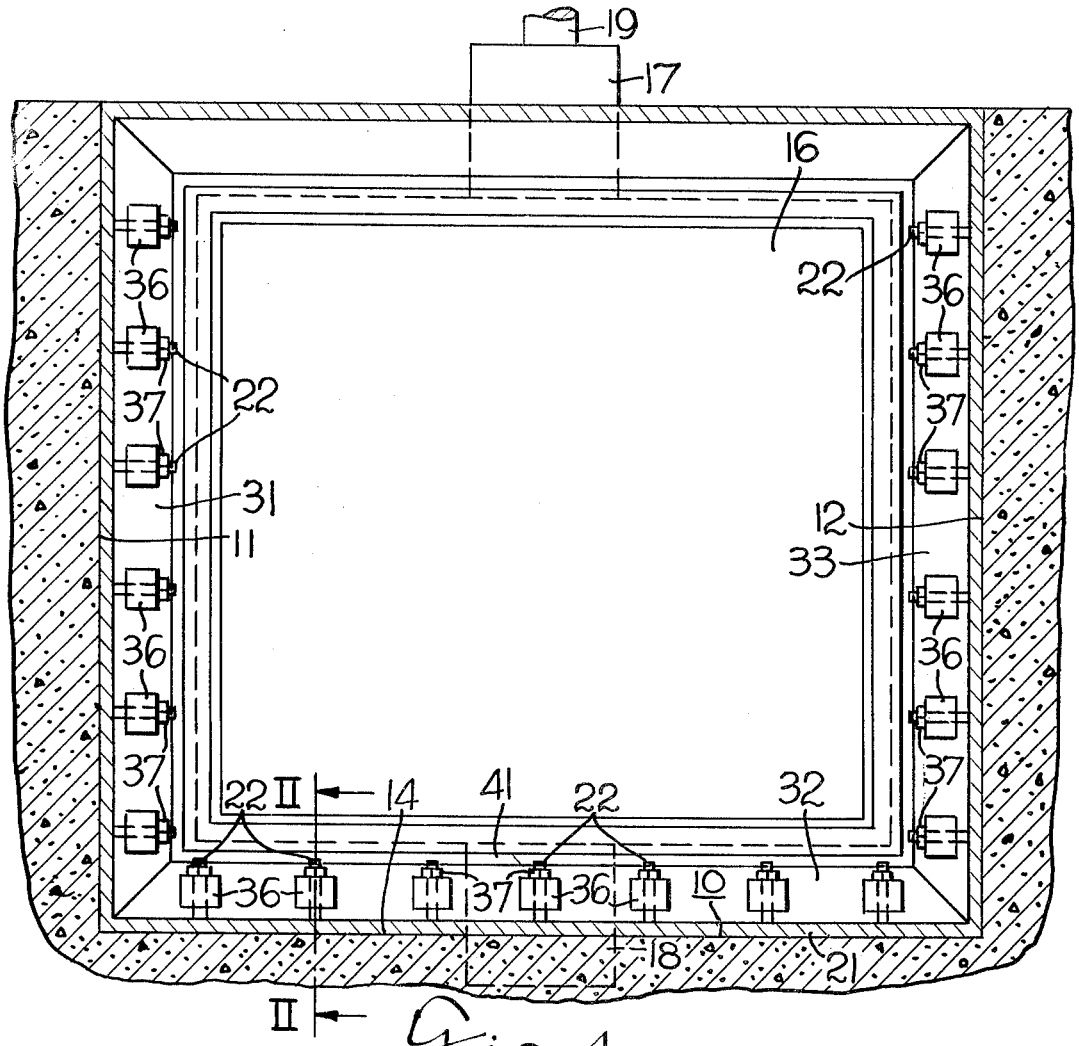
FIG. 1 is a view in cross section taken through a flume with the valve body in place therein.

Referring to FIG. 1, a flume generally indicated by the reference number 10 includes side walls 11 and 12 and a floor or bottom wall 14. Within the flume 10 is a valve body 15 which provides a passage through which fluid in the flume may flow. Within the valve body 15 is a valve disc 16 which is journalled as at 17 and 18 at the top and bottom of the valve body 15 for rotation between open and closed positions within the valve body. A valve disc shaft 19 to which the valve disc 16 is secured extends upwardly to an operating mechanism (not shown) which may be of any suitable type.

Figure 2:
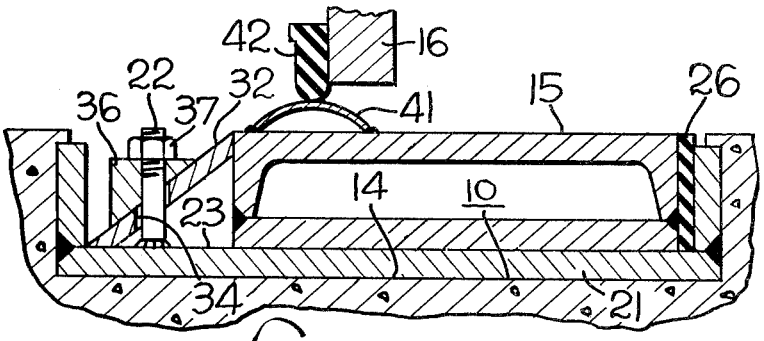
FIG. 2 is a view in section through the valve body and liners taken in a plane represented by the line II—II in FIG. 1; and, FIG. 3 is a view similar to FIG. 2 but showing a modification of the invention.

A groove liner 21 having a plurality of studs 22 that are welded in position to the liner floor 23 is cast into the flume concrete when the flume is constructed. This step permits later installation of the valve body 15 at the convenience of the builder and eliminates the danger of damage to the valve during the construction period. The valve body 15, which, as shown in FIG. 2, is a fabricated unit of rectangular cross section and is inserted into the groove liner 21. A gasket 26 surrounds the valve body 15 around the periphery thereof on one side of the valve body. The gasket 26 when compressed will provide a seal to prevent leakage of fluid around the valve body 15 when the disc 16 is in a fluid blocking position.

With the gasket 26 and valve body 15 in place within the groove liner 21, wedge plates 31, 32 and 33 are installed. To this end, the wedge plates are provided with openings, such as the opening 34, which are positioned to fit over the groove liner studs 22. Each stud 22 receives a bevelled washer 36 which is configured to engage the sloping surface of the wedge plate 32. Nuts 37 are threadedly engaged on the individual studs 22 and are tightened against the bevelled washers 36 thereby forcing the wedge plates 31, 32 and 33 against the upper portion of the valve body 15, as depicted in FIG. 2. The lower edges of the wedge plates 31, 32 and 33 react against the inside corners of the groove liner 21 to thereby develop a force which is transmitted to the valve body 15. This force engages the valve body 15 against the gasket 26 compressing the gasket 26 between the valve body 15 and the groove liner 21 to provide a fluid seal.

The method and apparatus of the invention provides a simple, practical and relatively inexpensive means of installing a valve in a flume. The installation may be readily dismantled for servicing the valve should the occasion require.

As shown in FIG. 2, the valve body 15 is provided with a sealing seat 41. The seat 41 extends around the inner surface of the valve body 15 in position to be engaged by the edge of a disc seal 42 carried by the valve disc 16. This arrangement provides a fluid seal between the disc 16 and the valve body 15 when the disc is in fluid position.

Figure 3:
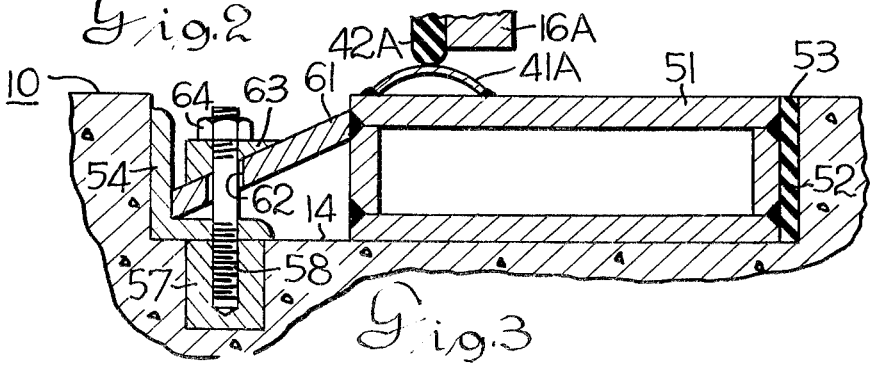

A modification of the invention of FIGS. 1 and 2 is disclosed in FIG. 3. As thereshown, a valve body 51 of rectangular configuration is inserted directly into the groove formed in the flume 10. A gasket 52, similar to gasket 26 of FIG. 2, is inserted between the cast groove 53 and surrounds the valve body 51. To effect a wedge lock of the valve body 51 in operative position, an angle member 54 is disposed around the valve body groove 53 at the side of the groove opposite to the side with which the gasket 52 abuts. To anchor the angle member in position, a plurality of anchor blocks, such as the blocks 57, are cast in place in the groove. Studs 58 are inserted through suitable openings provided in the leg of the angle member 54 and are threadedly engaged in the anchor blocks. Wedge plates 61 are fitted in position between the upper or outer portion of the valve body 51 and the inside corners of the groove 53. The wedge plates are provided with openings such as 62 which are positioned to receive the studs 58. Bevelled washers, represented by the bevelled washer 63, are engaged on the studs 58 and are configured to abut the surface of the wedge plate 61, as shown. Nuts 64 are threadedly engaged on the threaded extending ends of the studs and serve to force fully engage the bevelled washer 63 with the wedge plate 61. This action, as previously mentioned, forces the valve body 51 rightwardly, as viewed in FIG. 3, to compress the gasket 52 and provide a fluid seal. A valve disc gasket 41A is provided against which seal 42A of the valve disc 16A engages for effecting a fluid seal.

The embodiments of the invention in which an exclusive property or privilege is claimed are defined as follows:

1. A valve for installation in a flume:

a groove liner within a groove cast when constructing the flume;

a valve body defining a fluid passage within said liner, said valve body being of a size so as not to extend outside of the flume;

a plurality of threaded studs anchored to said groove liner and extending inwardly therefrom;

wedge plates operable to engage with said valve body and the groove liner at an angle, said wedge plates having openings which are positioned to permit passage of said studs therethrough;

force applying means operable to engage with said wedge plates to move said valve body into forceful engagement with said gasket to compress the same, said wedge plates also operating to lock said valve body within said groove liner, comprising, bevelled washers engaged over each of the studs, said bevelled washers having a wedge plate abutting surface which is complementary to the sloping surface of said wedge plate as installed;

a threaded nut engaged on each stud in position to exert a force on the associated bevelled washer to force said wedge plate into force applying relationship between the groove liner and the valve body; and, a valve disc pivotally supported within the fluid passage defined by said valve body for movement between an open and a fluid blocking position.

* * * * *